US010077524B2

(12) United States Patent
Davis

(10) Patent No.: US 10,077,524 B2
(45) Date of Patent: Sep. 18, 2018

(54) WASHING MACHINE APPLIANCE AND SUSPENSION ASSEMBLY FOR SAME

(71) Applicant: General Electric Company, Schenectady, NY (US)

(72) Inventor: Paul Owen Davis, Prospect, KY (US)

(73) Assignee: Haler US Appliance Solutions, Inc., Wilmington, DE (US)

( * ) Notice: Subject to any disclaimer, the term of this patent is extended or adjusted under 35 U.S.C. 154(b) by 161 days.

(21) Appl. No.: 15/072,422

(22) Filed: Mar. 17, 2016

(65) Prior Publication Data

US 2017/0268148 A1 Sep. 21, 2017

(51) Int. Cl.
*D06F 37/24* (2006.01)
*D06F 37/26* (2006.01)

(52) U.S. Cl.
CPC ..... *D06F 37/268* (2013.01); *D06F 37/24* (2013.01)

(58) Field of Classification Search
CPC ..... D06F 37/24; D06F 37/20; D06F 37/22; D06F 37/268
See application file for complete search history.

(56) References Cited

U.S. PATENT DOCUMENTS

2016/0010259 A1* 1/2016 Jeon ..... D06F 37/24 68/132
2016/0010261 A1* 1/2016 Kim ..... D06F 37/24 68/23.2

FOREIGN PATENT DOCUMENTS

WO WO-2014158493 A1 * 10/2014 ..... D06F 37/24
WO WO2015125075 A1 8/2015

* cited by examiner

*Primary Examiner* — Joseph L Perrin
*Assistant Examiner* — Irina Graf
(74) *Attorney, Agent, or Firm* — Dority & Manning, P.A.

(57) ABSTRACT

A suspension assembly for suspending a tub in a washing machine appliance includes a damper assembly. The damper assembly includes a capsule, the capsule including a body extending between a first end and a second end along a longitudinal axis and defining an interior, the first end defining an opening of the interior. The damper assembly further includes a cap connectable to the capsule at the first end of the capsule. The cap includes a body which defines a central bore hole extending along the longitudinal axis and a cavity surrounding the central bore hole. The cap further includes a tapered ridge extending from a surface defining the cavity, the tapered ridge tapering towards and bordering the central bore hole.

20 Claims, 4 Drawing Sheets

WASHING MACHINE APPLIANCE AND SUSPENSION ASSEMBLY FOR SAME

FIELD OF THE INVENTION

The present subject matter relates generally to washing machine appliances, such as vertical axis washing machine appliances, and suspension assemblies for washing machine appliances. In particular, the present subject matter relates to suspension assemblies which provide drain features for directing liquid away from suspension assembly components.

BACKGROUND OF THE INVENTION

Washing machine appliances generally include a cabinet which receives a tub for containing wash and rinse water. A wash basket is rotatably mounted within the wash tub. A drive assembly is coupled to the wash tub and configured to rotate the wash basket within the wash tub in order to cleanse articles within the wash basket. Upon completion of a wash cycle, a pump assembly can be used to rinse and drain soiled water to a draining system.

Washing machine appliances include vertical axis washing machine appliances and horizontal axis washing machine appliances, where "vertical axis" and "horizontal axis" refer to the axis of rotation of the wash basket within the wash tub. Vertical axis washing machine appliances typically have the wash tub suspended in the cabinet with suspension devices. The suspension devices generally allow the tub to move relative to the cabinet during operation of the washing machine appliance.

Many suspension devices utilize foam materials for dampening purposes. A concern during washing machine appliance operation is that liquid (such as water) can contact the foam material. This contact can interfere with the damping properties of the foam materials and cause the operation of the washing machine appliance to be degraded.

Accordingly, improved suspension assemblies which provide drain features for directing liquid away from suspension assembly components, such as foam materials, would be advantageous.

BRIEF DESCRIPTION OF THE INVENTION

In accordance with one embodiment, a suspension assembly for suspending a tub in a washing machine appliance is provided. The suspension assembly includes a damper assembly. The damper assembly includes a capsule, the capsule including a body extending between a first end and a second end along a longitudinal axis and defining an interior, the first end defining an opening of the interior. The damper assembly further includes a cap connectable to the capsule at the first end of the capsule. The cap includes a body which defines a central bore hole extending along the longitudinal axis and a cavity surrounding the central bore hole. The cap further includes a tapered ridge extending from a surface defining the cavity, the tapered ridge tapering towards and bordering the central bore hole.

In accordance with another embodiment, a washing machine appliance is provided. The washing machine appliance includes a cabinet, and a tub disposed within the cabinet. The washing machine appliance further includes a plurality of suspension assemblies suspending the tub within the cabinet. Each of the plurality of suspension assemblies includes a damper assembly. The damper assembly includes a capsule, the capsule including a body extending between a first end and a second end along a longitudinal axis and defining an interior, the first end defining an opening of the interior. The damper assembly further includes a cap connectable to the capsule at the first end of the capsule. The cap includes a body which defines a central bore hole extending along the longitudinal axis and a cavity surrounding the central bore hole. The cap further includes a tapered ridge extending from a surface defining the cavity, the tapered ridge tapering towards and bordering the central bore hole. Each of the plurality of suspension assemblies further includes a foam disposed within the interior, a rod extending through the central bore hole and the interior, and a compression spring surrounding the capsule.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
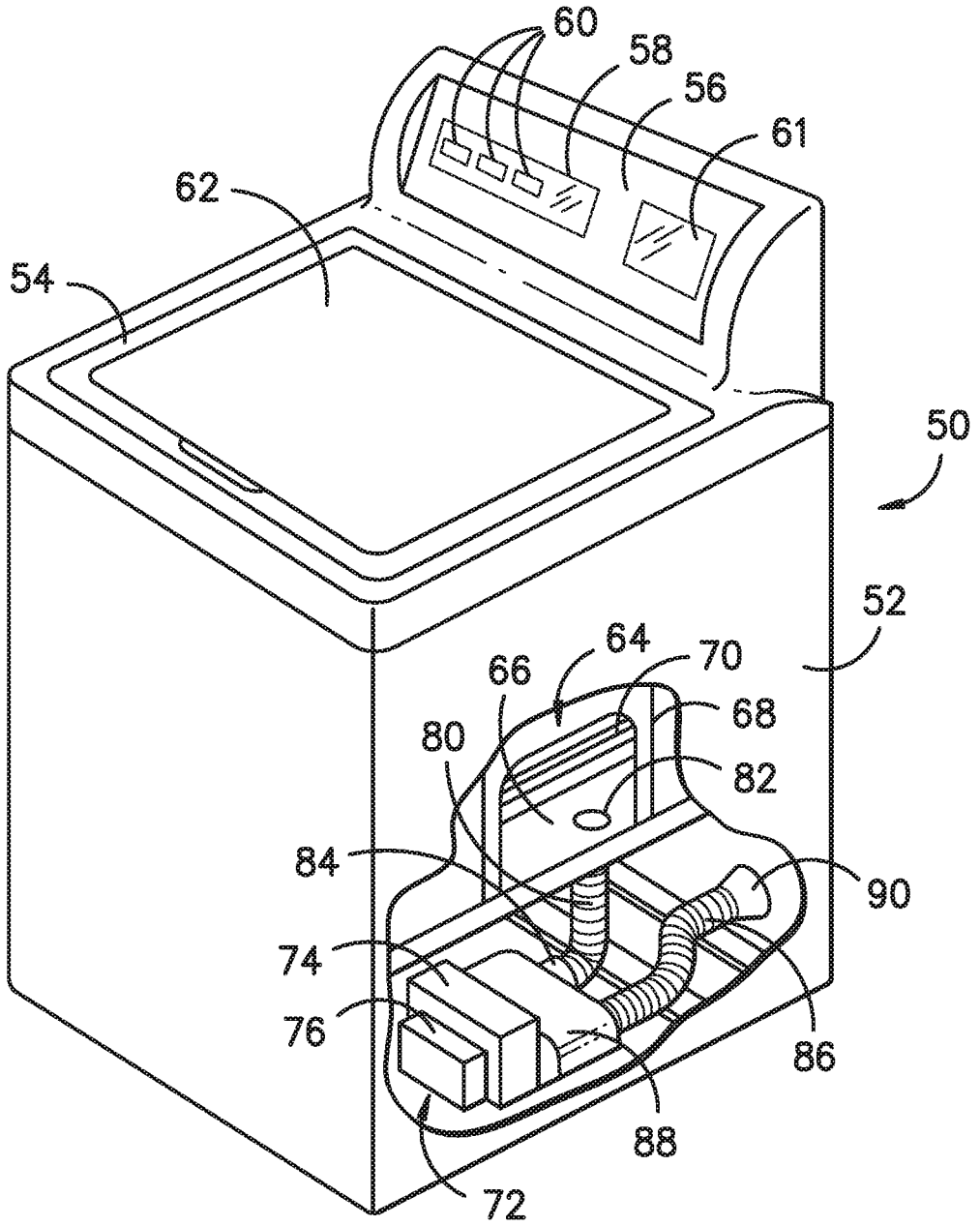
FIG. 1 provides a perspective view of a washing machine appliance, with a portion of a cabinet of the washing machine appliance shown broken away in order to reveal certain interior components of the washing machine appliance, in accordance with embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within cabinet 52, and a closed position (shown in FIG. 1) forming a sealed enclosure over wash tub 64.

As illustrated in FIG. 1, washing machine appliance 50 is a vertical axis washing machine appliance. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances.

Tub 64 includes a bottom wall 66 and a sidewall 68, and a basket 70 is rotatably mounted within wash tub 64. A pump assembly 72 is located beneath tub 64 and basket 70 for gravity assisted flow when draining tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
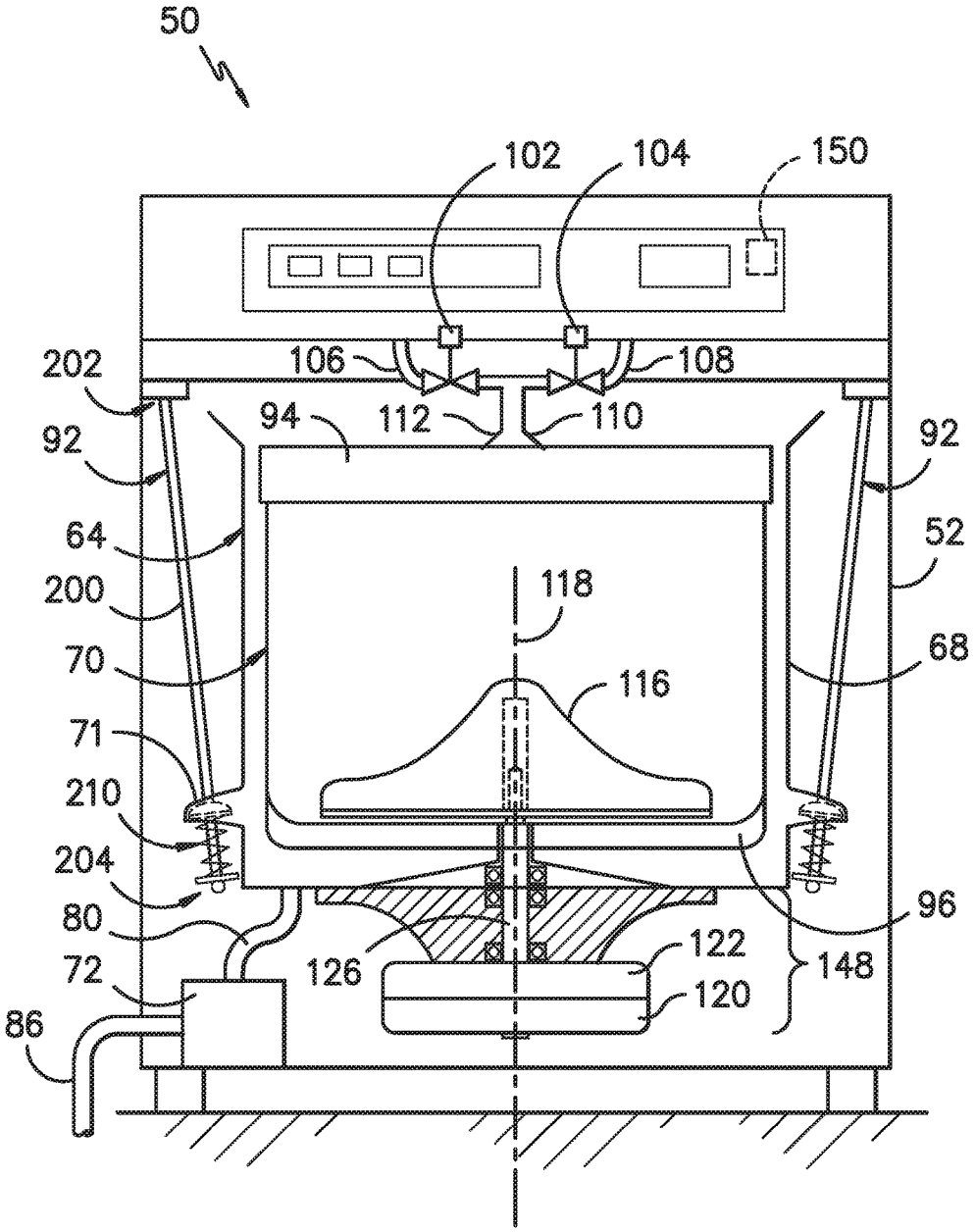
FIG. 2 provides a front elevation schematic view of various components of the washing machine appliance of FIG. 1.
Figure 3:
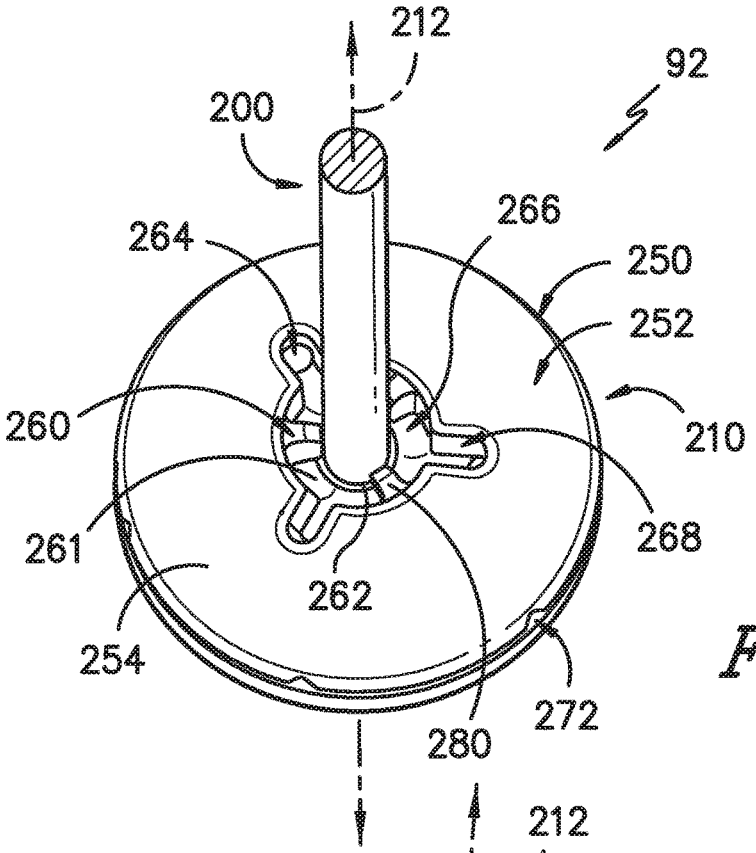
FIG. 3 is a top perspective view of components of a suspension assembly for a washing machine appliance in accordance with embodiments of the present disclosure.
Figure 4:
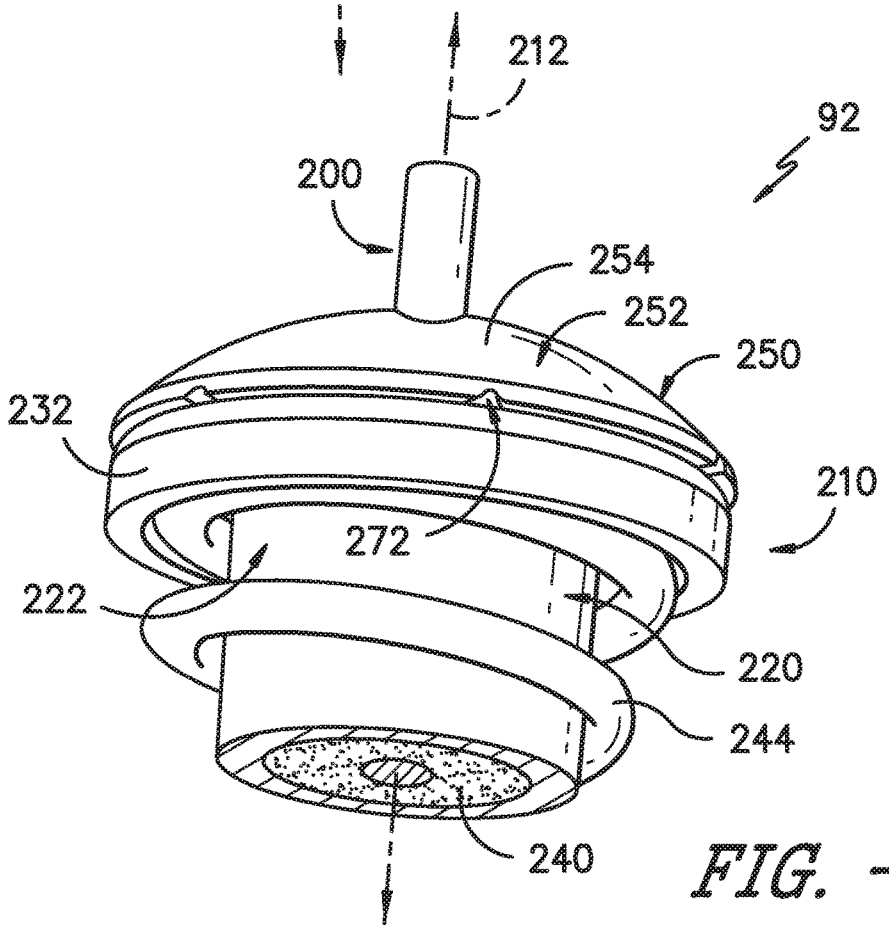
FIG. 4 is a bottom perspective view of components of a suspension assembly for a washing machine appliance in accordance with embodiments of the present disclosure.
Figure 5:
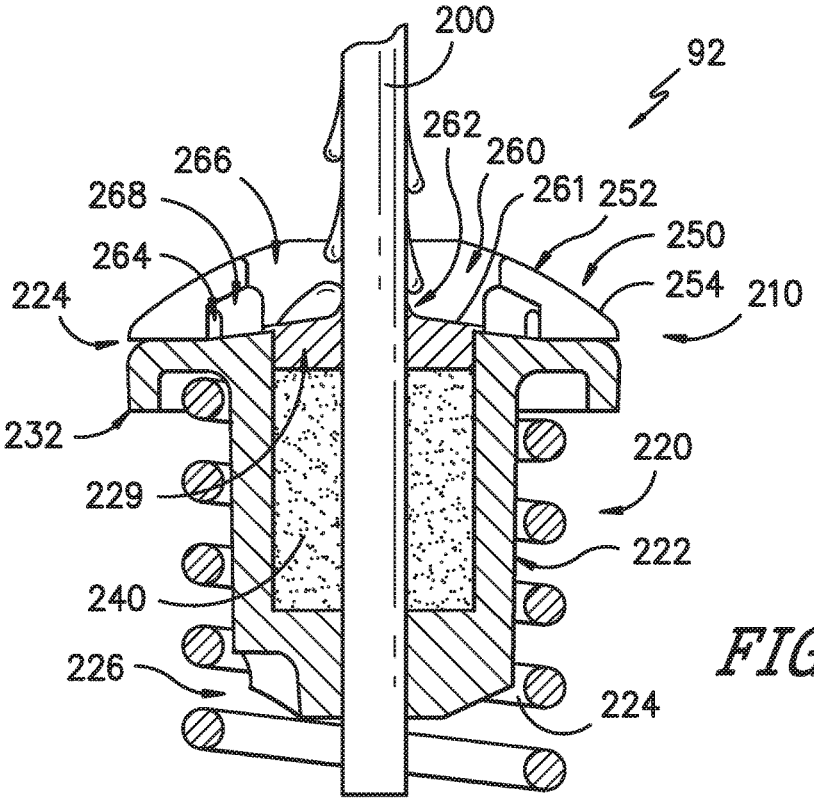
FIG. 5 is a cross-sectional view of components of a suspension assembly for a washing machine appliance in accordance with embodiments of the present disclosure.
Figure 6:
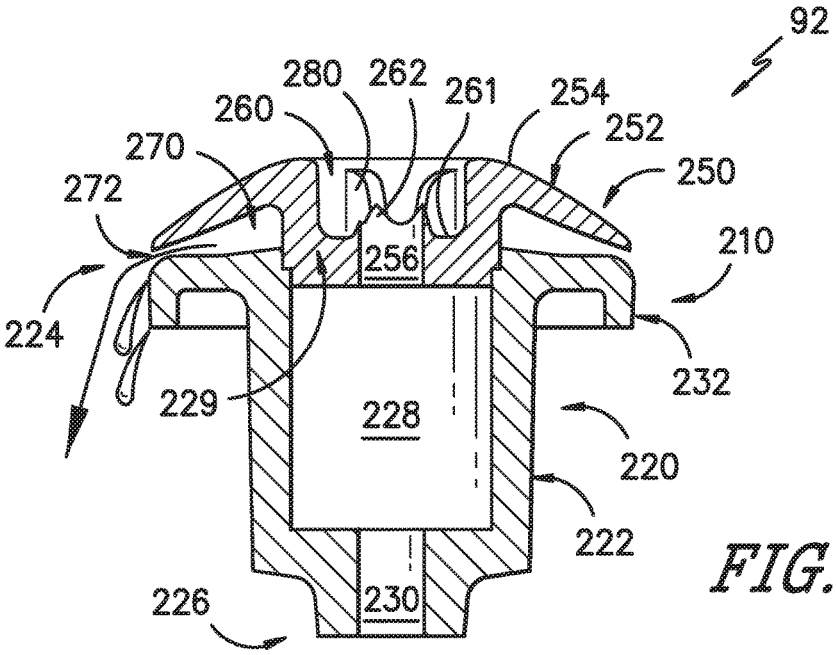
FIG. 6 is another cross-sectional view of components of a suspension assembly for a washing machine appliance in accordance with embodiments of the present disclosure.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver liquid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and liquid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

An agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about a vertical axis 118.

Basket 70 and agitator 116 are driven by a motor 120 through a transmission and clutch system 122. The motor 120 drives shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 148.

Basket 70, tub 64, and machine drive system 148 are supported by a vibration dampening suspension system. The dampening suspension system can include one or more suspension assemblies 92, as discussed herein, coupled between and to the cabinet 52 and wash tub 64. Typically, four suspension assemblies 92 are utilized, and are spaced apart about the wash tub 64. For example, each suspension assembly 92 may be connected at one end proximate a corner of the cabinet 52 and at an opposite end to the wash tub 64. The washer can include other vibration dampening elements, such as a balance ring 94 disposed around the upper circumferential surface of the wash basket 70. The balance ring 94 can be used to counterbalance an out of balance condition for the wash machine as the basket 70 rotates within the wash tub 64. The wash basket 70 could also include a balance ring 96 located at a lower circumferential surface of the wash basket 70.

A dampening suspension system generally operates to dampen dynamic motion as the wash basket 70 rotates within the tub 64. The dampening suspension system has various natural operating frequencies of the dynamic system. These natural operating frequencies are referred to as the modes of suspension for the washing machine. For instance, the first mode of suspension for the washing machine occurs when the dynamic system including the wash basket 70, tub 64, and dampening suspension system are operating at the first resonant or natural frequency of the dynamic system.

Operation of washing machine appliance 50 is controlled by a controller 150 which is operatively coupled to the user interface input located on washing machine backsplash 56 (shown in FIG. 1) for user manipulation to select washing machine cycles and features. In response to user manipulation of the user interface input, controller 150 operates the various components of washing machine appliance 50 to execute selected machine cycles and features.

In an illustrative embodiment, laundry items are loaded into basket 70, and washing operation is initiated through operator manipulation of control input selectors 60 (shown in FIG. 1). Tub 64 is filled with water and mixed with detergent to form a wash fluid, and basket 70 is agitated with agitation element 116 for cleansing of laundry items in basket 70. That is, agitation element is moved back and forth in an oscillatory back and forth motion. In the illustrated embodiment, agitation element 116 is rotated clockwise a specified amount about the vertical axis of the machine, and then rotated counterclockwise by a specified amount. The clockwise/counterclockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, tub 64 is drained with pump assembly 72. Laundry items are then rinsed and portions of the cycle may be repeated, including the agitation phase, depending on the particulars of the wash cycle selected by a user.

Referring now to FIGS. 3 through 6, exemplary embodiments of suspension assemblies 92 in accordance with various embodiments of the present disclosure are shown. As discussed herein, suspension assemblies 92 in accordance with the present disclosure may advantageously include features for directing liquid (such as water) therefrom, thus reducing the potential for contact between such liquid and foam components of the suspension assemblies 92. Specifically, features of suspension assemblies 92 as discussed herein may direct liquid from rods of the suspension assemblies 92 to reduce the potential for this liquid to travel via the rods to contact foam components of the suspension assemblies 92.

As shown, suspension assembly 92 may include a rod 200 which extends between a first end 202 and a second end 204. As discussed, the rod 200 may be connected proximate the first end 202 to the cabinet 52, and may be connected proximate the second end 204 to the tub 64.

A suspension assembly 92 may further include a damper assembly 210. Damper assembly 210 may be mounted to rod 200, such as proximate the second end 204 (relative to the first end 202), and rod 200 may thus extend through the damper assembly 210. Damper assembly 210 may generally provide damping features to the suspension assembly 92. For example, damper assembly 210 may include a capsule 220. The capsule 220 may include a body 222 which extends between a first end 224 and a second end 226 along a longitudinal axis 212 of the damper assembly 210. The body 222 may, for example, be generally cylindrically-shaped. An interior 228 may be defined within the body 222. The interior 228 may have a shape that corresponds to a shape of the body 222, and may thus for example be generally cylindrically-shaped. An opening 229 defined in the first end 224 may provide access to the interior 228.

Rod 200 may extend through the opening 229 and interior 228, such as along the longitudinal axis 212. Further, in exemplary embodiments, a bore hole 230 may be defined in the body 222. The bore hole 230 may extend, such as along the longitudinal axis 212, between the interior 228 and the second end 226. For example, bore hole 230 may be a central bore hole 230 which is thus concentric with the longitudinal axis 212. The rod 200 may additionally extend through the bore hole 230 along the longitudinal axis 212. Notably, the bore hole 230 may have a maximum width/diameter that is less than a maximum width/diameter of the interior 228. The rod 200 may thus for example contact the sidewalls defining the bore hole 230, and a relatively tight tolerance may be defined between the rod 200 and bore hole 230.

Additionally, in exemplary embodiments, the capsule 220 may include a flange 232. The flange 232 may, for example, be disposed at the first end 224, and may thus form a portion of the first end 224 along with the body 222 portion of the first end 224. The flange 232 may, for example, extend radially outward from the body 222, such as at the first end 224.

In exemplary embodiments, the body 222 and flange 232 are integral with each other, and thus integrally formed as a single, unitary component. Alternatively, however, the body 222 and flange 232 may be separate components that are connected together to form the capsule 222.

Suspension assembly 92 can further include a suitable damping material that is disposed within the interior 228. For example, in exemplary embodiments, damper assembly 210 includes a foam 240 disposed within the interior 228. The foam 240 may, for example, generally surround the portion of the rod 200 that extends through the interior 228. In exemplary embodiments, foam 240 is a compressed foam 240, which may for example be partially or fully open-cell. Exemplary foam 240 materials include, for example, microcellular urethanes.

In exemplary embodiments, suspension assembly 92 can further include a suitable biasing member which facilitates freedom of movement of the basket 70 within the tub 64. For example, a spring, such as a compression spring 244, may be provided. The compression spring 244 may surround the capsule 220, such as the body 222 thereof, and may contact the body 222 and/or flange 232 during operation. In exemplary embodiments as shown, the compression spring 244 is positioned below the flange 232 along the longitudinal axis 212, and thus supports the damper assembly 210 via contact with a bottom surface of the flange 232.

Returning now to the damper assembly 210, damper assembly 210 may additionally include a cap 250 that is connectable to (and thus connected to when assembled) the capsule 220 at the first end 224 of the capsule 220. The cap 250 may generally enclose the interior 228 by blocking access thereto through the opening 229. The cap 250 may advantageously include various drain features for reducing or preventing liquid flow through or around the cap 250 and into the interior 228.

The cap 250 may include a body 252 which includes an outer surface 254. The body 252 may be generally hemispherical-shaped, as illustrated. The wash tub 64, such as a radially extending tab 71 thereof, may contact the cap 250 such that the tub 64 is supported by the cap 250, and the damper assembly 210 and suspension assembly 92 generally.

A bore hole 256 may be defined in the body 252. The bore hole 256 may extend, such as along the longitudinal axis 212 through the body 252. For example, bore hole 256 may be a central bore hole 256 which is thus concentric with the longitudinal axis 212. The rod 200 may extend through the bore hole 256 along the longitudinal axis 212. Notably, the bore hole 256 may have a maximum width/diameter that is less than a maximum width/diameter of the interior 228 and approximately equal to the bore hole 230. The rod 200 may thus for example contact the sidewalls defining the bore hole 256, and a relatively tight tolerance may be defined between the rod 200 and bore hole 256.

A cavity 260 may additionally be defined in the body 252. The cavity 260 is generally a depression that is defined in the body 252, such that for example a portion 261 of the outer surface 254 is depressed relative to the hemispherically-shaped remaining portion of the outer surface 254. The cavity 260 may surround the central bore hole 256, and may for example be concentric with the longitudinal axis 212. Further, in exemplary embodiments as shown, the surface 261 may be sloped radially outward from the central bore hole 256. Such slope in exemplary embodiments may be a downward slope (i.e. vertically downward along the longitudinal axis 212), which may facilitate the flow of liquid on the surface 261 away from the central bore hole 256.

A ridge 262 may be provided in the cavity 260, and may extend from the surface 261 that defines the cavity 260. The ridge 262 may be annular or ring-shaped, as shown, and may be disposed at an edge of the cavity 260, thus surrounding and bordering the central bore hole 256. In some embodiments, as shown, the ridge 262 further has a wave-form shape, thus alternating between peaks and valleys annularly about its length. Alternatively, however, the ridge 262 may have a constant height annularly about its length, or may have other suitable variations in height annularly about its length. In exemplary embodiments as shown, the ridge 262 is tapered, such as towards the hole as it extends away from the surface 261. When the rod 200 extends through the bore hole 256, the rod 200 may contact the ridge 262. This contact causes liquid running down the surface of the rod 200 to flow from the rod 200 onto the ridge 262. This liquid may be flowed away from the rod 200 on the ridge 262 (such as via the tapered cross-sectional shape of the ridge 262), thus reducing or preventing liquid from continuing on the rod 200 through the central bore hole 256 into the interior 228 and contacting the foam 240. The liquid may instead flow onto the ridge 262 and from the ridge 262 to the surface 261.

A plurality of drain holes 264 may be defined in the cap 250, such as in the cavity 260 thereof. For example, each drain hole 264 may extend through the surface 261, as shown. The drain holes 264 may be disposed radially outward of the central bore hole 256 and the ridge 262, and may for example be disposed in a generally annular array. In exemplary embodiments as shown, the cavity 260 may include a central portion 266 (in which the central bore hole 256 is defined and from which the ridge 262 extends) and a plurality of radial extensions 268. Each radial extension 268 may extend generally radially away from the central portion 266. The radial extensions 268 may be disposed in a generally annular array. In these embodiments, each drain hole 264 may for example be disposed within a radial extension 268. Drain holes 264 may facilitate drainage of liquid from the cavity 260. For example, liquid in the cavity 260 may flow over the surface 261 to and through the drain holes 264.

Liquid this flowed from the cavity 260, such as through drain holes 264, may further be drained from the damper assembly 210. For example, a passage 270, which may for example be an annular passage, may be defined between the capsule 220 and cap 250, such as when the capsule 220 and cap 250 are connected. Liquid flowed from the cavity 260, such as through drain holes 264, may flow into the passage 270. Further, a plurality of peripheral weep holes 272 may be defined in the body 252 of the cap 250, such as in a peripheral edge of the body 252. The peripheral weep holes 272 may for example be disposed in a generally annular array. Each weep hole 272 may be in fluid communication with the passage 270. Accordingly, liquid within the passage 270 may flow through the weep holes 272 to be exhausted from the damper assembly 210.

In some exemplary embodiments, cap 250 further includes a plurality of ribs 280. The ribs 280 may be disposed within the cavity 260, such as within the central portion 266 thereof, and may thus extend from the surface 261 (such as along the longitudinal axis 212 away from the surface 261). The ribs 280 may be disposed in a generally annular array. The ribs 280 may surround the central bore hole 256, and may serve to guide the rod 200 as it is extended into and through the bore hole 256 during assembly of the suspension assembly 92. In exemplary embodiments as shown, ribs 280 may taper (in width and/or height) towards the central bore hole 256, and may for example taper to approximately the maximum height of an associated peak of ridge 262. Ribs 280 may further act to generally stabilize the rod 200 within the damper assembly 210.

The ridge 262 may be disposed generally radially between the bore hole 256 and the ribs 280. In some embodiments, for example, peaks of the ridge 262 may be in contact with (and optionally integral with) the ribs 280. Further, in exemplary embodiments, the various components of the cap 250, such as the body 252, surface 254, ridge 262, and ribs 264, are integral with each other, and thus integrally formed as a single, unitary component. Alternatively, however, these components may be separate components that are connected together to form the cap 250.

Ridge 262 may generally have any maximum height (above surface 261) which is suitable for directing liquid from an associated rod 200. In exemplary embodiments, the height 262 is greater than or equal to the diameter of the drops of liquid that form on the ridge 262 and cap 250 generally. The diameter of the drops is generally material dependent. In exemplary embodiments, for example, the cap 250 and components thereof may be formed from a high density polyethylene ("HDPE"). The capsule 220 and components thereof, and the damper assembly 210 generally, may additionally be formed in exemplary embodiments from a HDPE. Such material is advantageously non-polar and causes water to bead up into drops which are directed from the rod 200 as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A suspension assembly for suspending a tub in a washing machine appliance, the suspension assembly comprising:

a rod; and a damper assembly, the damper assembly comprising:

a capsule, the capsule comprising a capsule body extending between a first end and a second end along a longitudinal axis and defining an interior, the first end defining an opening of the interior; and a cap connectable to the capsule at the first end of the capsule, the cap comprising a body which defines a central bore hole extending along the longitudinal axis, an upper outer surface of the body having a peripheral hemispherically-shaped portion and a lower surface extending radially inward from the peripheral hemispherically-shaped portion defining an open cavity surrounding the central bore hole radially outward from the central bore hole, the cap further comprising a tapered ridge at least partially defining the central bore hole and extending upward from the lower surface, wherein the rod extends through the central bore hole and the interior of the capsule, wherein the open cavity is in fluid isolation from the interior of the capsule, wherein the tapered ridge has a height that is lower than a height of the peripheral hemispherically-shaped portion, and wherein an outer surface of the tapered ridge tapers down and away from the central bore hole to direct liquid away from the rod.

2. The suspension assembly of claim 1, wherein the tapered ridge has an annular wave-form shape.

3. The suspension assembly of claim 1, wherein the lower surface defining the open cavity is sloped radially outward from the central bore hole.

4. The suspension assembly of claim 1, wherein a plurality of drain holes are defined in the cap, each of the plurality of drain holes extending through the lower surface defining the open cavity.

5. The suspension assembly of claim 4, wherein the open cavity comprises a central portion and a plurality of radial extensions, and wherein each of the plurality of drain holes is defined in one of the plurality of radial extensions.

6. The suspension assembly of claim 1, wherein the cap further comprises a plurality of ribs disposed in the open cavity and surrounding the central bore hole.

7. The suspension assembly of claim 1, wherein an annular passage is defined between the capsule and the cap.

8. The suspension assembly of claim 7, wherein a plurality of peripheral weep holes are defined in the body of the cap, each of the plurality of peripheral weep holes in fluid communication with the annular passage.

9. The suspension assembly of claim 1, wherein a bore hole is defined in the capsule, the bore hole extending along the longitudinal axis between the interior and the second end.

10. The suspension assembly of claim 1, wherein the capsule comprises a flange extending radially outward from the capsule body at the first end.

11. The suspension assembly of claim 1, further comprising a foam disposed within the interior.

12. The suspension assembly of claim 1, further comprising a compression spring surrounding the capsule.

13. A washing machine appliance, the washing machine appliance comprising:

a cabinet;

a tub disposed within the cabinet; and a plurality of suspension assemblies suspending the tub within the cabinet, each of the plurality of suspension assemblies comprising:

a damper assembly, the damper assembly comprising:

a capsule, the capsule comprising a capsule body extending between a first end and a second end along a longitudinal axis and defining an interior, the first end defining an opening of the interior; and a cap connected to the capsule at the first end of the capsule, the cap comprising a body which defines a central bore hole extending along the longitudinal axis, an upper outer surface of the body having a peripheral hemispherically-shaped portion and a lower surface extending radially inward from the peripheral hemispherically-shaped portion defining an open cavity surrounding the central bore hole radially outward from the central bore hole, the cap further comprising a tapered ridge at least partially defining the central bore hole and extending upward from the lower surface;

a foam disposed within the interior;

a rod, the rod extending through the central bore hole and the interior; and a compression spring surrounding the capsule, wherein the open cavity is in fluid isolation from the interior of the capsule, wherein the tapered ridge has a height that is lower than a height of the peripheral hemispherically-shaped portion, and wherein an outer surface of the tapered ridge tapers down and away from the central bore hole to direct liquid away from the rod.

14. The washing machine appliance of claim 13, wherein the tapered ridge has an annular wave-form shape.

15. The washing machine appliance of claim 13, wherein the lower surface defining the open cavity is sloped radially outward from the central bore hole.

16. The washing machine appliance of claim 13, wherein a plurality of drain holes are defined in the cap, each of the plurality of drain holes extending through the lower surface defining the open cavity.

17. The washing machine appliance of claim 13, wherein an annular passage is defined between the capsule and the cap.

18. The washing machine appliance of claim 17, wherein a plurality of peripheral weep holes are defined in the body of the cap, each of the plurality of peripheral weep holes in fluid communication with the annular passage.

19. The washing machine appliance of claim 13, wherein a bore hole is defined in the capsule, the bore hole of the capsule extending along the longitudinal axis between the interior and the second end, and wherein the rod extends through the bore hole of the capsule.

20. A suspension assembly for suspending a tub in a washing machine appliance, the suspension assembly comprising:

a rod; and a damper assembly, the damper assembly comprising:

a capsule, the capsule comprising a capsule body extending between a first end and a second end along a longitudinal axis and defining an interior, the first end defining an opening of the interior; and a cap connectable to the capsule at the first end of the capsule, the cap comprising a body which defines a central bore hole extending along the longitudinal axis, an upper outer surface of the body having a peripheral hemispherically-shaped portion and a lower surface extending radially inward from the peripheral hemispherically-shaped portion defining an open cavity surrounding the central bore hole radially outward from the central bore hole, the cap further comprising a tapered ridge at least partially defining the central bore hole and extending upward from the lower surface, wherein the rod extends through the central bore hole and the interior of the capsule, wherein the open cavity is in fluid isolation from the interior of the capsule, wherein the tapered ridge has a height that is lower than a height of the peripheral hemispherically-shaped portion, wherein an outer surface of the tapered ridge tapers down and away from the central bore hole to direct liquid away from the rod, wherein a plurality of drain holes are defined in the cap, each of the plurality of drain holes extending through the lower surface defining the open cavity wherein an annular passage is defined between the capsule and the cap in fluid communication with the drain holes to receive liquid from the drain holes, and wherein a plurality of peripheral weep holes are defined in the body of the cap, each of the plurality of peripheral weep holes in fluid communication with the annular passage to receive liquid from the annular passage.

* * * * *